US011255594B2

(12) United States Patent
Carlton et al.

(10) Patent No.: US 11,255,594 B2
(45) Date of Patent: Feb. 22, 2022

(54) COVER FOR A CONDENSATE COLLECTION TROUGH

(71) Applicant: Johnson Controls Technology Company, Auburn Hills, MI (US)

(72) Inventors: Drew H. Carlton, Wichita, KS (US); Cody J. Kaiser, Wichita, KS (US); Wayne E. Romero, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 271 days.

(21) Appl. No.: 16/137,267

(22) Filed: Sep. 20, 2018

(65) Prior Publication Data

US 2020/0064054 A1 Feb. 27, 2020

Related U.S. Application Data

(60) Provisional application No. 62/721,420, filed on Aug. 22, 2018.

(51) Int. Cl.
*F25D 21/14* (2006.01)
*F24F 13/22* (2006.01)

(52) U.S. Cl.
CPC ..... *F25D 21/14* (2013.01); *F24F 13/222* (2013.01)

(58) Field of Classification Search
CPC ..... F24F 13/222; F25D 21/14
See application file for complete search history.

(56) References Cited

U.S. PATENT DOCUMENTS

| | | | | |
|---|---|---|---|---|
| 2,175,396 | A * | 10/1939 | Hoffman | A47F 3/0417 62/290 |
| 4,083,198 | A * | 4/1978 | Dennis | B60H 1/00528 62/244 |
| 5,979,171 | A | 11/1999 | Mitchell et al. | |
| 6,901,766 | B1 | 6/2005 | Jin et al. | |
| 7,669,641 | B2 | 3/2010 | Rembold et al. | |
| 7,793,514 | B2 | 9/2010 | Rios et al. | |
| 9,279,620 | B2 | 3/2016 | Edens et al. | |
| 9,995,495 | B2 | 6/2018 | Edens et al. | |
| 2007/0169493 | A1 | 7/2007 | Rios | |
| 2007/0169495 | A1 | 7/2007 | Thomas et al. | |
| 2007/0169497 | A1 | 7/2007 | Rios | |
| 2012/0000231 | A1* | 1/2012 | LaFontaine | F25D 21/14 62/291 |
| 2015/0153095 | A1 | 6/2015 | Mercer et al. | |
| 2019/0308492 | A1* | 10/2019 | Buckman | B60H 1/3233 |

FOREIGN PATENT DOCUMENTS

| | | | |
|---|---|---|---|
| EP | 1910759 | A2 | 4/2008 |
| WO | 2009036531 | A2 | 3/2009 |

* cited by examiner

*Primary Examiner* — Christopher R Zerphey
(74) *Attorney, Agent, or Firm* — Fletcher Yoder, P.C.

(57) ABSTRACT

Embodiments of the present disclosure are directed to a condensate collection assembly that includes a condensate collection trough configured to couple to the heat exchanger, the condensate collection trough having a condensate receptacle and a channel, the condensate receptacle is configured to be positioned adjacent to a condensate flow path of the heat exchanger and receive a condensate from the condensate flow path, and the channel is configured to direct the condensate from the condensate receptacle to a condensate pan and a cover disposed over the channel, where the cover is configured to restrict a flow of air from entering the channel.

23 Claims, 13 Drawing Sheets

COVER FOR A CONDENSATE COLLECTION TROUGH

CROSS REFERENCE TO RELATED APPLICATIONS

This application claims priority from and the benefit of U.S. Provisional Application Ser. No. 62/721,420, entitled "COVER FOR A CONDENSATE COLLECTION TROUGH," filed Aug. 22, 2018, which is hereby incorporated by reference in its entirety for all purposes.

BACKGROUND

The present disclosure relates generally to environmental control systems, and more particularly, to a cover for a condensate collection trough of a heating, ventilation, and/or air conditioning (HVAC) unit.

Environmental control systems are utilized in residential, commercial, and industrial environments to control environmental properties, such as temperature and humidity, for occupants of the respective environments. The environmental control system may control the environmental properties through control of an airflow delivered to the environment. In some cases, environmental control systems include heat exchangers that produce condensate from air, or another suitable fluid, as the air transfers thermal energy to a refrigerant flowing through tubes of the heat exchanger. In particular, during the transfer of thermal energy, water within the air condenses to form liquid droplets. Further, such heat exchangers may be adjusted to various positions, such that multiple condensate collection pans may be included with the heat exchanger to enable adequate condensate draining when the heat exchanger is in a given position. Unfortunately, air may flow into a condensate collection trough of the condensate pan when the heat exchanger is in certain positions, thereby causing condensate to inadvertently escape the condensate collection trough in an unintended manner as the air passes over the heat exchanger.

DRAWINGS

SUMMARY

Figure 1:
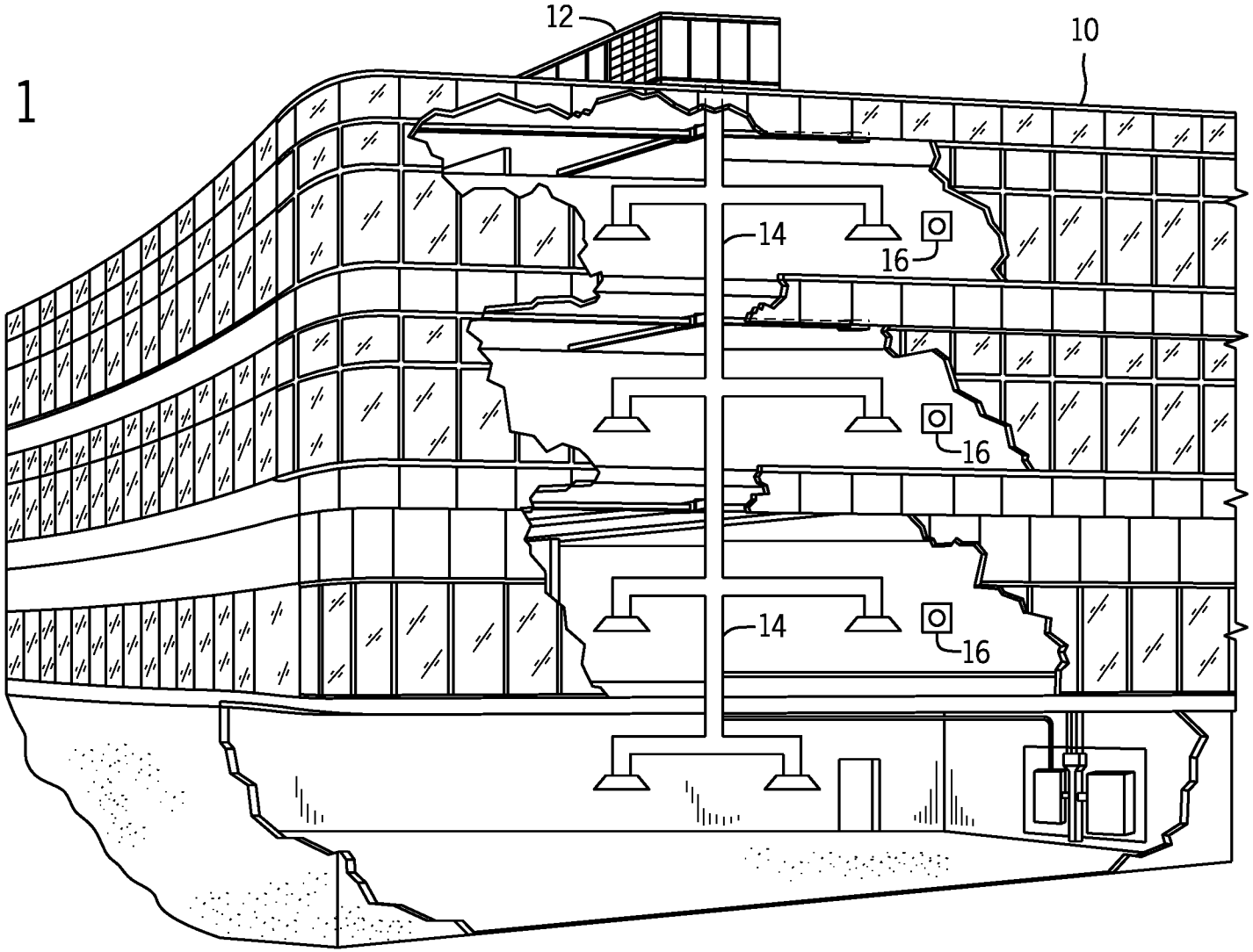
FIG. 1 is a schematic of an embodiment of an HVAC system for building environmental management that may employ an HVAC unit, in accordance with an aspect of the present disclosure.

In one embodiment of the present disclosure, a condensate collection assembly includes a condensate collection trough configured to couple to the heat exchanger, the condensate collection trough having a condensate receptacle and a channel, the condensate receptacle is configured to be positioned adjacent to a condensate flow path of the heat exchanger and receive a condensate from the condensate flow path, and the channel is configured to direct the condensate from the condensate receptacle to a condensate pan and a cover disposed over the channel, where the cover is configured to restrict a flow of air from entering the channel.

In another embodiment of the present disclosure, a heating, ventilation, and/or air conditioning (HVAC) system includes a heat exchanger configured to place a working fluid in a heat exchange relationship with an airflow, and a condensate collection assembly. The condensate collection assembly includes a condensate collection trough having a condensate receptacle and a channel, where the condensate collection trough is configured to couple to the heat exchanger, the condensate receptacle is configured to be positioned adjacent to a condensate flow path of the heat exchanger and receive a condensate from the condensate flow path, and the channel is configured to direct the condensate from the condensate receptacle to a condensate pan and a cover configured to restrict the airflow from entering the channel, where the cover is disposed over the channel.

In a further embodiment of the present disclosure, a cover for a condensate collection system includes a body portion having a first end, a second end opposite the first end, a first side, and a second side opposite the first side, where the body portion is configured to be disposed over a channel of a condensate collection trough of the condensate collection system, and where the condensate collection trough is configured to receive condensate generated by a heat exchanger, a guide portion configured to direct an airflow over an external surface of the body portion and away from the channel of the condensate collection trough, where the guide portion is coupled to the first end of the body portion, and a coupling portion configured to couple the cover to the heat exchanger, where the coupling portion is coupled to the first side of the body portion.

Other features and advantages of the present application will be apparent from the following, more detailed description of the embodiments, taken in conjunction with the accompanying drawings which illustrate, by way of example, the principles of the application.

DETAILED DESCRIPTION

The present disclosure is directed to a cover for a condensate collection trough of a heat exchanger that may be included in a heating, ventilation, and/or air conditioning (HVAC) system. Specifically, the cover is configured to block, restrict, or prevent an airflow from contacting, removing, or otherwise interfering with a flow of condensate in the condensate collection trough when the heat exchanger is in a particular position. As set forth above, typical heat exchangers may be adjusted to various positions based on an operating mode of a system in which the heat exchanger is utilized, size constraints of a location at which the heat exchanger is positioned, and/or a position of an air handler, duct, or other component that may receive the airflow from the heat exchanger. When the heat exchanger is positioned in certain positions, such as a horizontal left position, the airflow through the heat exchanger may contact condensate within the condensate collection trough and inadvertently force the condensate out of the condensate collection trough in an unintended manner. For example, the airflow may inadvertently direct the condensate toward an air handler, a duct, or an environment that is configured to be conditioned by the airflow. In some cases, the condensate may become entrained within the airflow, which may cause the condensate to be present in air that is ultimately directed to the environment, thereby increasing a humidity level within the environment and/or otherwise causing liquid to be present within the environment.

Accordingly, embodiments of the present disclosure are directed to a cover that is positioned over a condensate collection trough of a heat exchanger in order to block, restrict, or prevent the airflow from contacting, blowing, and/or otherwise directing condensate out of the condensate collection trough and/or toward the environment to be conditioned by the airflow. For instance, the cover may be configured to be disposed over a channel of the condensate collection trough that directs condensate from a condensate receptacle of the condensate collection trough to a condensate pan. In some embodiments, the cover may be formed from a single piece of sheet metal and may include various portions that are configured to cover the condensate collection trough, as well as direct the airflow around the condensate collection trough toward the environment. The cover may include a body portion, a first guide portion, a second guide portion, a coupling portion, and/or an overlap portion. The body portion may be disposed over the condensate collection trough, and specifically the channel or condensate channel of the condensate collection trough. The first guide portion and the second guide portion may guide the airflow around the condensate channel and/or may otherwise block, restrict, or prevent the airflow from entering the condensate channel. The coupling portion may enable the cover to be coupled to the heat exchanger, the condensate collection trough, or both. Further, the overlap portion may be configured to block, restrict, or prevent the airflow from entering a gap between the body portion and the channel of the condensate collection trough. In any case, the cover may reduce contact between the airflow and condensate within the condensate collection trough, thereby reducing an amount of condensate that is inadvertently directed out of the condensate collection trough toward the environment.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
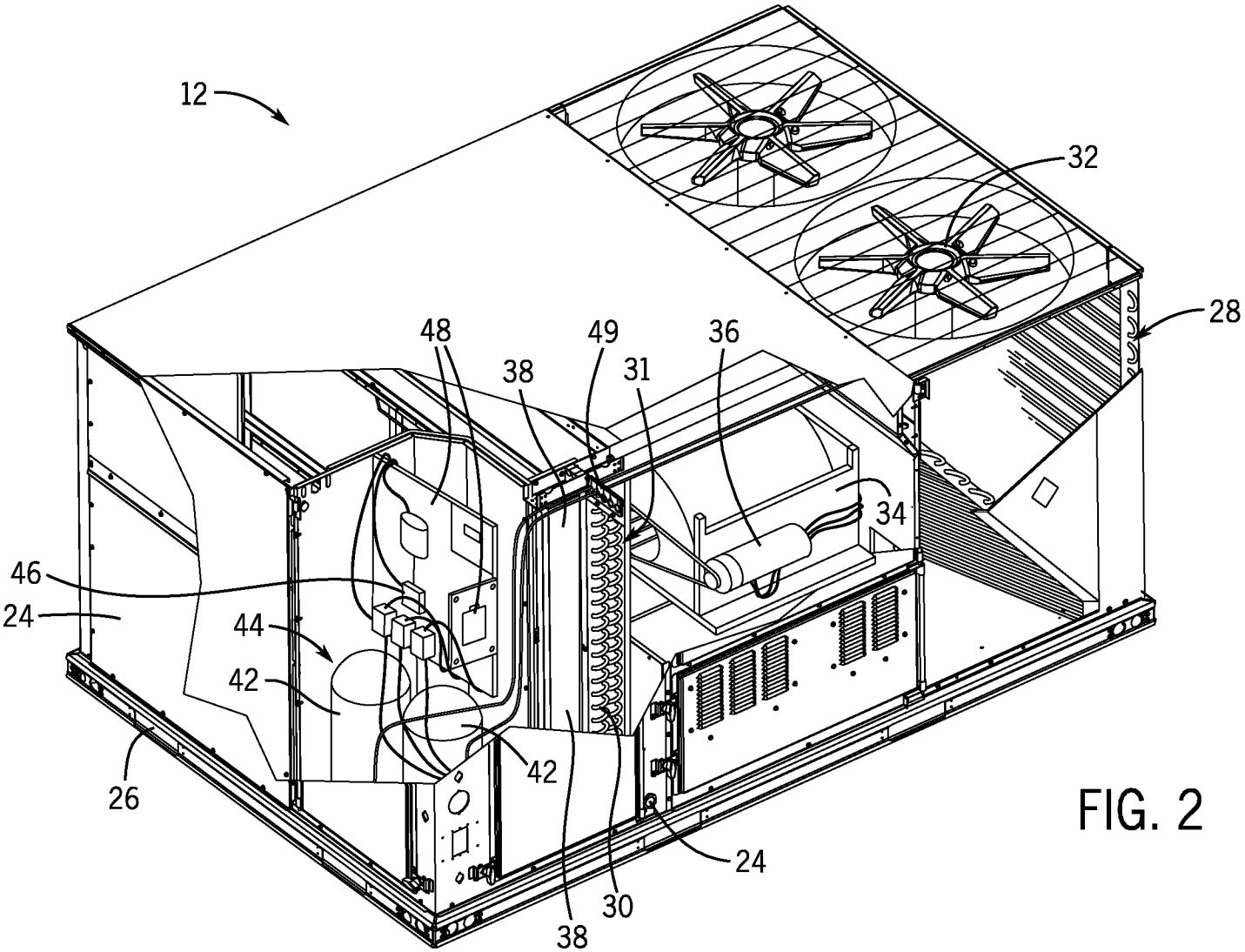
FIG. 2 is a perspective view of an embodiment of an HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
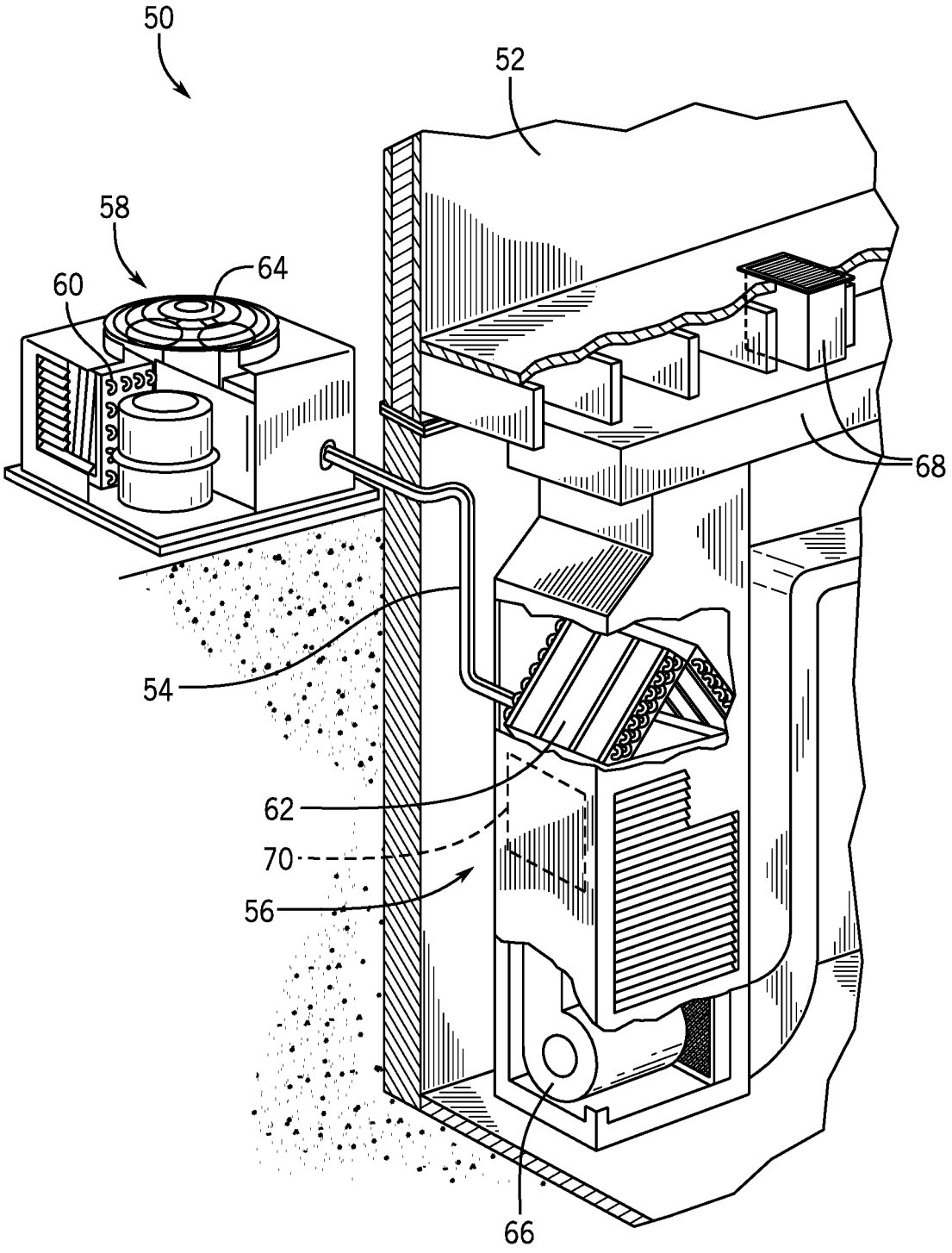
FIG. 3 is a cutaway perspective view of an embodiment of a residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
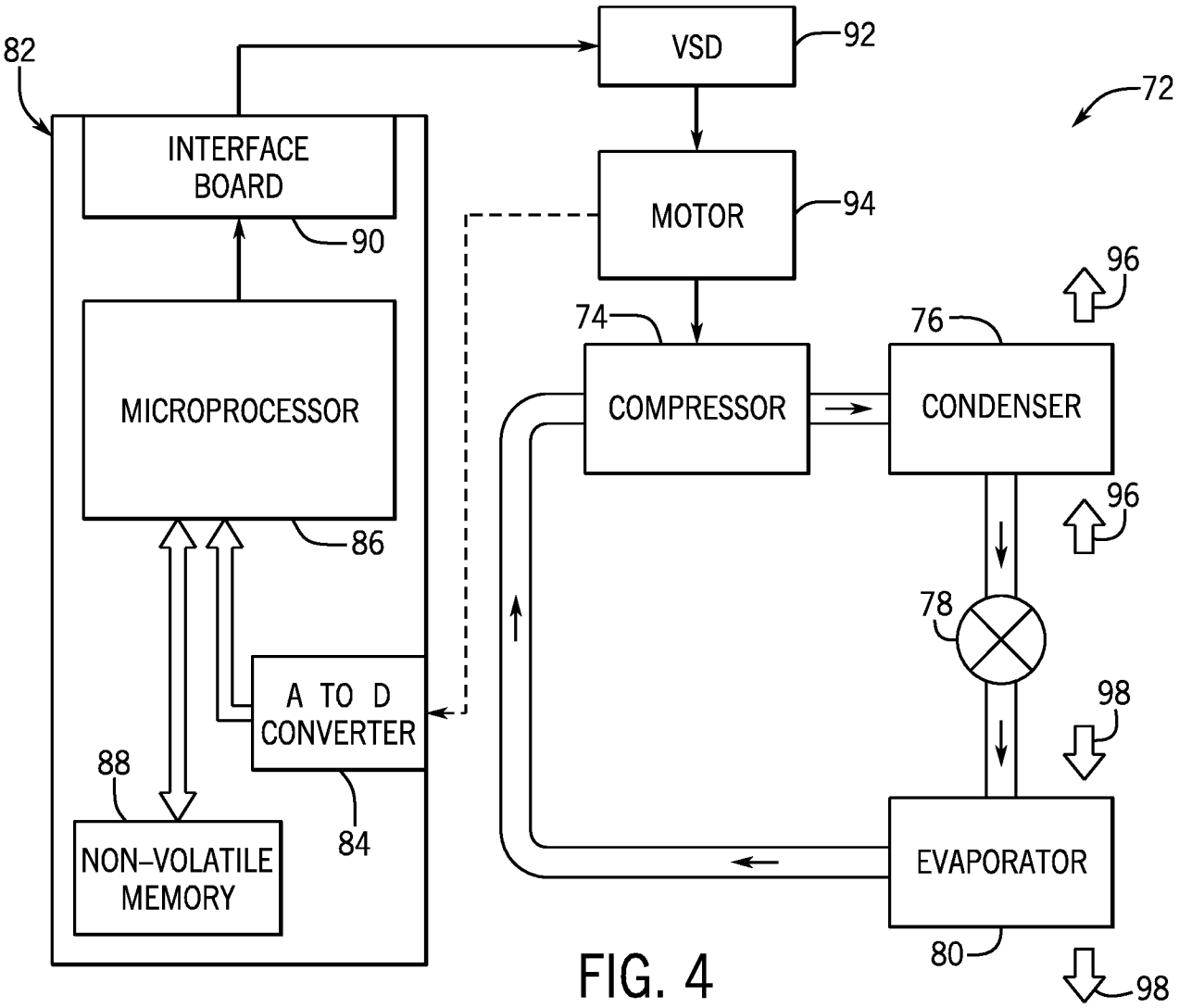
FIG. 4 is a schematic of an embodiment of a vapor compression system that may be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to a cover for a condensate collection trough of a heat exchanger 100, such as the heat exchanger 28, the heat exchanger 60, the heat exchanger 62, and/or the evaporator 80. During operation of the heat exchanger 100, refrigerant flowing through tubes of the heat exchanger 100 absorbs thermal energy from an airflow directed across the tubes. In some cases, water particles within the airflow may condense, thereby generating liquid condensate that collects on the tubes of the heat exchanger 100 and/or falls below the tubes of the heat exchanger 100 due to gravitational force. Traditional heat exchangers may include a condensate collection trough that is configured to receive and/or collect condensate from a condensate flow path of the heat exchanger and direct the condensate toward a condensate pan, where the condensate is typically directed toward a drain. As used herein, the condensate flow path of the heat exchanger may include conduits, channels, passages, spaces, gaps, or other features that enable the condensate to be directed from coils of the heat exchanger 100 toward a condensate collection trough.

For example, condensate that collects on the coils of the heat exchanger 100 may flow through conduits, passages, or channels toward the condensate collection trough. Additionally or alternatively, the condensate may drip or fall from the coils through a space or gap and into the condensate collection trough via gravitational force. Further still, the condensate may be directed along the condensate flow path of the heat exchanger using any suitable features of the heat exchanger.

Unfortunately, when the heat exchanger 100 is in certain positions, such as a horizontal left position, the airflow through the heat exchanger 100 may contact condensate in the condensate collection trough and contact, blow, or otherwise direct the condensate out of the condensate collection trough and potentially toward a duct, vent, air handler, or other component that may enable the condensate to reach the building 10. In some circumstances, the condensate may become entrained within the airflow. In some cases, condensate within the airflow that ultimately reaches the building 10 may increase a humidity level within the building 10 and/or reduce an efficiency of the HVAC unit 12 and/or residential heating and cooling system 50.

Figure 5:
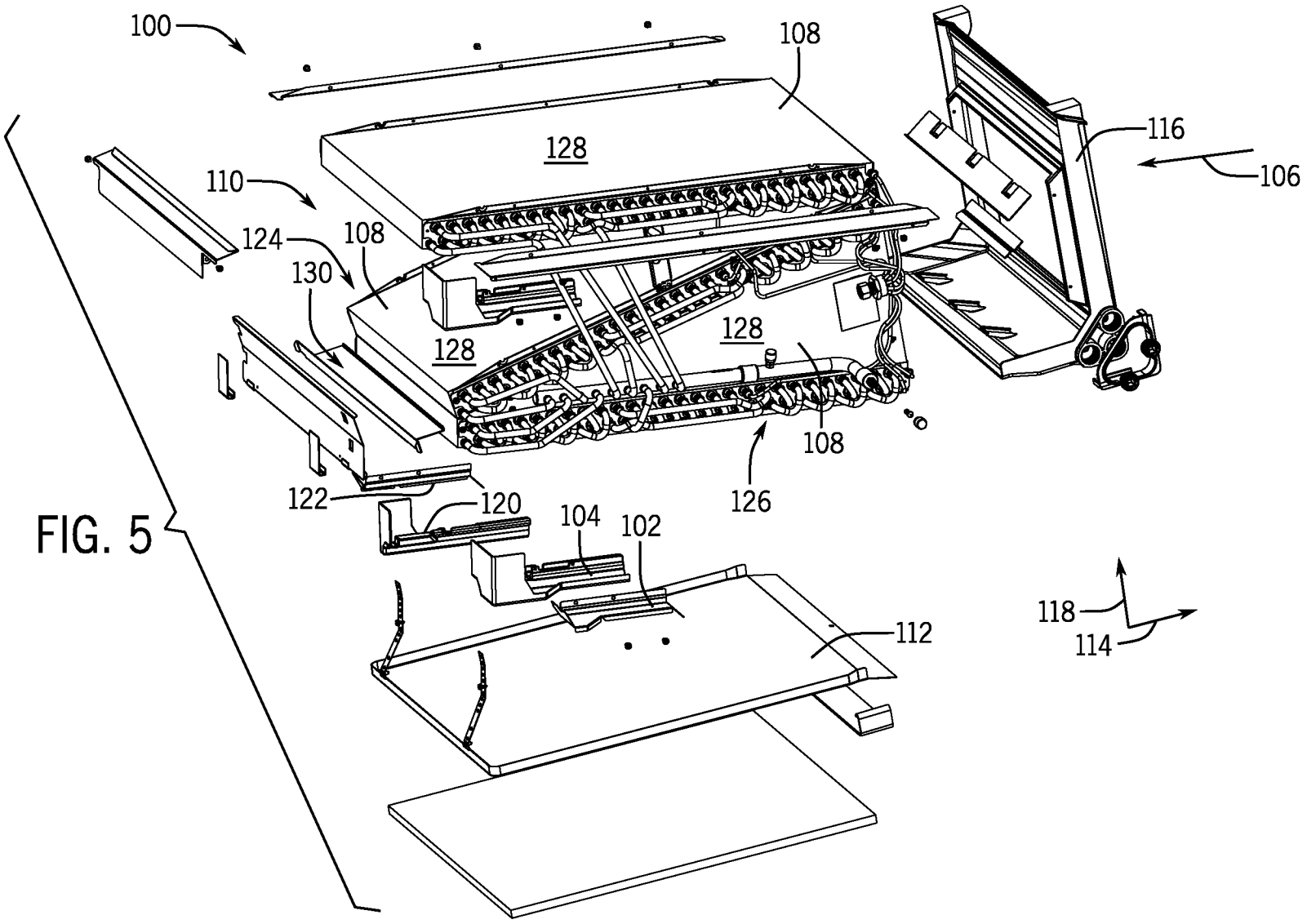
FIG. 5 is an exploded perspective view of an embodiment of a heat exchanger that includes a cover for a condensate collection trough of the heat exchanger, in accordance with an aspect of the present disclosure.

Accordingly, embodiments of the present disclosure are directed to a cover 102 that may be disposed over a condensate collection trough 104 of the heat exchanger 100 in order to block or prevent an airflow 106 flowing across the heat exchanger 100 from contacting condensate within the condensate collection trough 104. For instance, FIG. 5 is an exploded perspective view of an embodiment of the heat exchanger 100 having the cover 102. As shown in the illustrated embodiment of FIG. 5, the heat exchanger 100 includes coils 108 that are arranged in a horizontal left configuration 110. In other words, the coils 108 are positioned substantially horizontally, or substantially parallel, to a horizontal drain pan 112 of the heat exchanger 100 with respect to an axis 114, and positioned to the left of a vertical drain pan 116 with respect to the axis 114 and/or a direction of the airflow 106. In other embodiments, the coils 108 of the heat exchanger 100 may be positioned in a vertical position, where the coils 108 are substantially crosswise to the horizontal drain pan 112 and are disposed along an axis 118. In still further embodiments, the coils 108 of the heat exchanger 100 may be positioned in a horizontal right configuration, where the coils 108 are substantially parallel to the horizontal drain pan 112 and/or the axis 114 and to the right of the vertical drain pan 116 with respect to the axis 114 and/or the direction of the airflow 106.

In any case, the cover 102 is disposed over the condensate collection trough 104 and is coupled to the coils 108, or a casing that houses the coils 108, of the heat exchanger 100. In some embodiments, the heat exchanger 100 includes a second condensate collection trough 120 having a second cover 122 disposed on a side 124 of the heat exchanger 100 that is opposite a side 126 of the heat exchanger 100 having the condensate collection trough 104 and the cover 102. As such, condensate may flow from the coils 108 toward either side 124, 126 of the heat exchanger 100 and be collected by the first or second condensate collection troughs 104, 120. In other words, the condensate may flow along a condensate flow path from the coils 108 toward the condensate collection troughs 104, 120. For instance, condensate may form on surfaces 128 of the coils 108 and flow, drip, or otherwise be directed along the condensate flow path toward a condensate passage 130 that directs the condensate toward the side 124 and/or the side 126 and into the condensate collection troughs 120, 104, respectively. Thereafter, the condensate collection troughs 120, 104 direct the condensate toward the horizontal drain pan 112 disposed beneath the condensate collection troughs 120, 104 and the coils 108. In any case, the covers 102, 122 block or prevent the airflow 106 from contacting condensate that flows from the condensate collection troughs 104, 120 toward the horizontal drain pan 112.

Figure 6:
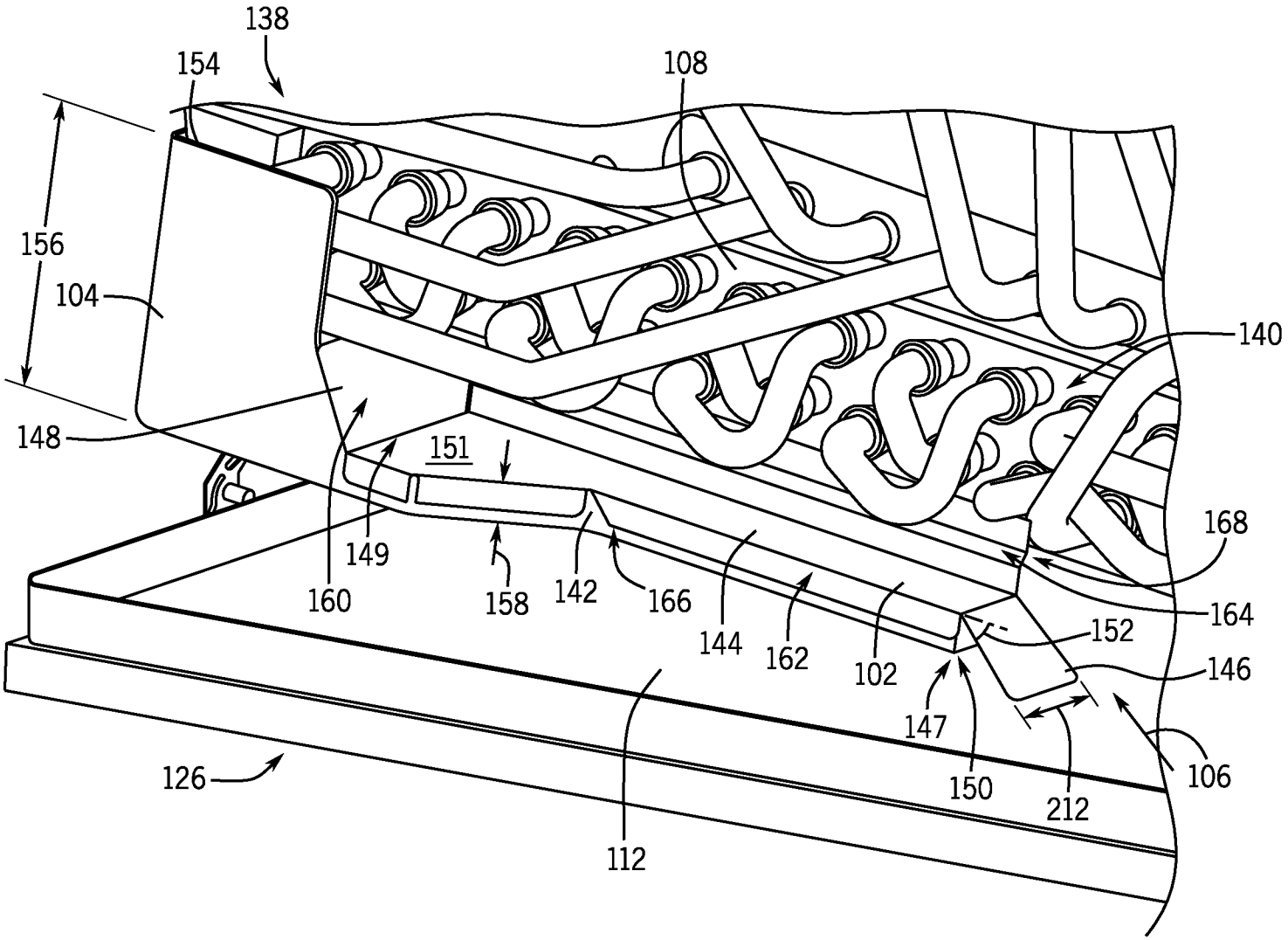
FIG. 6 is a partial perspective view of an embodiment of the cover disposed over the condensate collection trough of the heat exchanger, in accordance with an aspect of the present disclosure.

FIG. 6 is a partial perspective view of an embodiment of a condensate collection assembly 138 that includes the cover 102 that is disposed over the condensate collection trough 104 and is attached to a coil 140 of the coils 108. While the illustrated embodiment of FIG. 6 shows the cover 102 and/or the condensate collection trough 104 coupled to the coil 140, it should be noted that in other embodiments, the cover 102 and/or the condensate collection trough 104 may be coupled to any suitable portion of the heat exchanger 100, such as the coils 108, a casing that houses the coils 108, another housing of the heat exchanger 100, an end plate of the heat exchanger 100, and/or another suitable component of the heat exchanger. As shown in the illustrated embodiment, the cover 102 includes a shape that substantially conforms to a channel 142 of the condensate collection trough 104, and the cover 102 is disposed over the channel 142. In this manner, the cover 102 is configured to block, restrict, or prevent the airflow 106 from contacting condensate flowing from the condensate collection trough 104 and through the channel 142 to the horizontal drain pan 112. In some embodiments, the cover 102 is formed from a single piece of material, such as sheet metal, plastic, or another suitable material. In other embodiments, the cover 102 may be formed from multiple pieces of material that are coupled to one another via fasteners, welds, adhesives, brackets, or other suitable coupling techniques.

As shown in the illustrated embodiment of FIG. 6, the cover 102 includes a body portion 144 that is positioned over the condensate collection trough 104 to cover the channel 142 of the condensate collection trough 104. Additionally, the cover 102 includes a first guide portion 146 disposed on a first end 147 of the body portion 144 and a second guide portion 148 disposed on a second end 149 of the body portion 144, opposite the first end 147. The first guide portion 146 and the second guide portion 148 are configured to guide and direct air over an external surface 151 of the cover 102 and away from the channel 142. For instance, the first guide portion 146 is positioned upstream from the body portion 144 with respect to a direction of the airflow 106 and covers an outlet 150 of the channel 142 that enables the condensate to flow from the channel 142 of the condensate collection trough 104 to the horizontal drain pan 112. The first guide portion 146 forms an angle 152 with the body portion 144 of the cover 102, and thus, guides the airflow 106 along the first guide portion 146 toward the external surface 151 of the body portion 144 and away from the outlet 150 of the channel 142. Additionally, the second guide portion 148 is configured to block or prevent the airflow 106 from entering a condensate receptacle 154 of the condensate collection trough 104. The condensate receptacle 154 of the condensate collection trough 104 receives condensate from the condensate flow path of the heat exchanger 100 and directs the condensate toward the channel 142. The condensate receptacle 154 may include a height 156 that is greater than a height 158 of the channel 142 of the condensate collection trough 104. As such, the second guide portion 148 extends across a gap 160 formed between the body portion 144 and the condensate receptacle 154 of the condensate collection trough 104 that is created by the differences in heights 156, 158 in order to block the airflow 106 from entering the condensate receptacle 154 through the gap 160.

Further still, the cover 102 includes an overlap portion 162 and a coupling portion 164 disposed on opposing sides 166 and 168 of the condensate collection trough 104. For instance, the overlap portion 162 may fold over the side 166 of the condensate collection trough 104 along the channel 142 to block the airflow 106 from entering the channel 142 via an opening between the body portion 144 of the cover 102 and the channel 142. Additionally, the coupling portion 164 of the cover 102 may enable the cover 102 to be secured to, or coupled to, the coil 140. In some cases, the side 168 of the condensate collection trough 104 may also be coupled to the coupling portion 164 of the cover 102 to facilitate coupling both the condensate collection trough 104 and the cover 102 to the coil 140.

Figure 7:
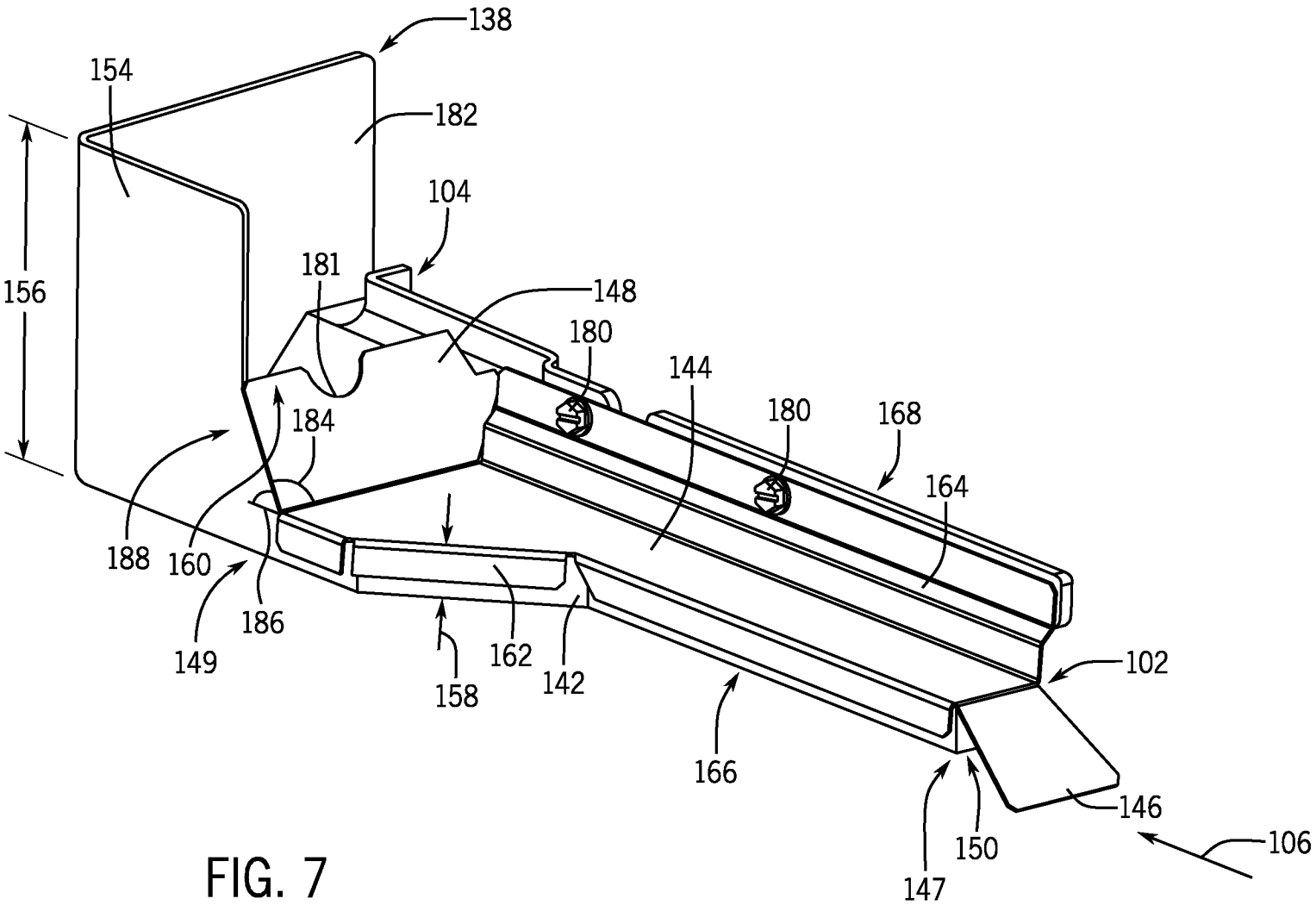
FIG. 7 is a perspective view of an embodiment of the cover coupled to the condensate collection trough, in accordance with an aspect of the present disclosure.

For example, FIG. 7 is a perspective view of an embodiment of the cover 102 coupled to the condensate collection trough 104 via the coupling portion 164. As shown in the illustrated embodiment of FIG. 7, the coupling portion is coupled to the side 168 of the condensate collection trough 104 via fasteners 180. Additionally, the fasteners 180 may couple both the cover 102 and the condensate collection trough 104 to the coil 140. While the illustrated embodiment of FIG. 7 shows two of the fasteners 180 coupling the cover 102 to the condensate collection trough 104, in other embodiments, the cover 102 may be coupled to the condensate collection trough 104 using one, three, four, five, six, seven, eight, nine, ten, or more than ten of the fasteners 180. In any case, the cover 102 and the condensate collection trough 104 are secured to the coil 140, such that the cover 102 blocks or prevents the airflow 106 from contacting the condensate flowing through the channel 142 of the condensate collection trough 104. As such, condensate within the condensate collection trough 104 may not be mixed into the airflow 106 that is ultimately directed toward the building 10 or other conditioned space.

As shown in the illustrated embodiment of FIG. 7, the second guide portion 148 does not completely cover the condensate receptacle 154 of the condensate collection trough 104. Accordingly, condensate may still be directed from the coils 108 toward the condensate receptacle 154 via the condensate flow path without restriction from the cover 102. Moreover, the airflow 106 may not remove condensate from the condensate collection trough 104 via the condensate receptacle 154 because various tubes and/or other features of the coils 108 may at least partially cover the condensate receptacle 154 and also block the airflow 106, as shown in FIG. 6, for example. Further, the height 156 of the condensate receptacle 154 may be configured to surround a portion of the coil 140, such that any condensate contacted by the airflow 106 in the condensate receptacle 154 is blocked or prevented from being removed from the condensate receptacle 154 by the height 156, or a back portion 182, of the condensate receptacle 154. Further still, the second guide portion 148 of the cover 102 may include a groove or recessed feature 181 that is configured to receive a tube of the coils 108 and/or tubes of a header 183, as shown in FIG. 6. Accordingly, the cover 102 may be configured to block a larger portion of the gap 160 between the body portion 144 of the cover 102 and the condensate receptacle 154 of the condensate collection trough 104 because the cover 102 includes the groove or recessed feature 181, which accommodates the tubes and enables the cover 102 to extend beyond such features of the heat exchanger 100.

In some embodiments, the second guide portion 148 forms an angle 184 with respect to the body portion 144 of the cover 102. The angle 184 may be substantially equal to an angle 186 of a sloped surface 188 between the channel 142 and the condensate receptacle 154 of the condensate collection trough 104. As such, the second guide portion 148 may further block the airflow 106 from entering into the channel 104 and/or the condensate receptacle 154.

As discussed above, the cover 102 may be formed from a sheet metal, a polymeric or plastic material, or another suitable material. In some embodiments, the condensate collection trough 104 may be formed from the same material as the cover 102. In other embodiments, the condensate collection trough 104 may be formed from a different material than the cover 102. For example, the cover 102 may be formed from a single piece of sheet metal that is formed and/or machined to form the body portion 144, the first guide portion 146, the second guide portion 148, the overlap portion 162, and the coupling portion 164, while the condensate collection trough 104 is formed from a polymeric material, such as plastic. In such embodiments, the condensate collection trough 104 may be molded into the shape that includes the condensate receptacle 154 and the channel 142.

Figure 8:
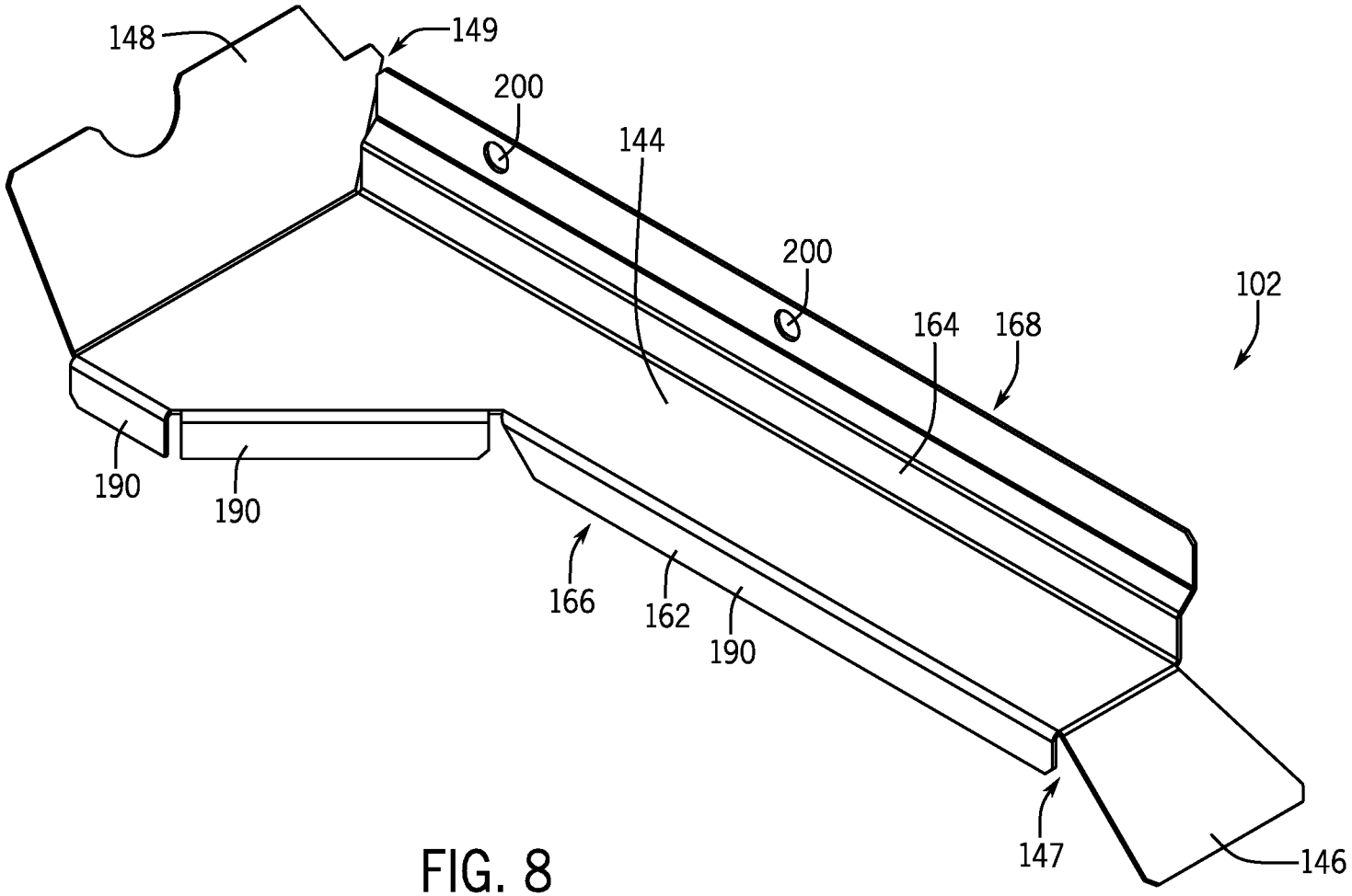
FIG. 8 is a perspective view of an embodiment of the cover, in accordance with an aspect of the present disclosure.
Figure 9:
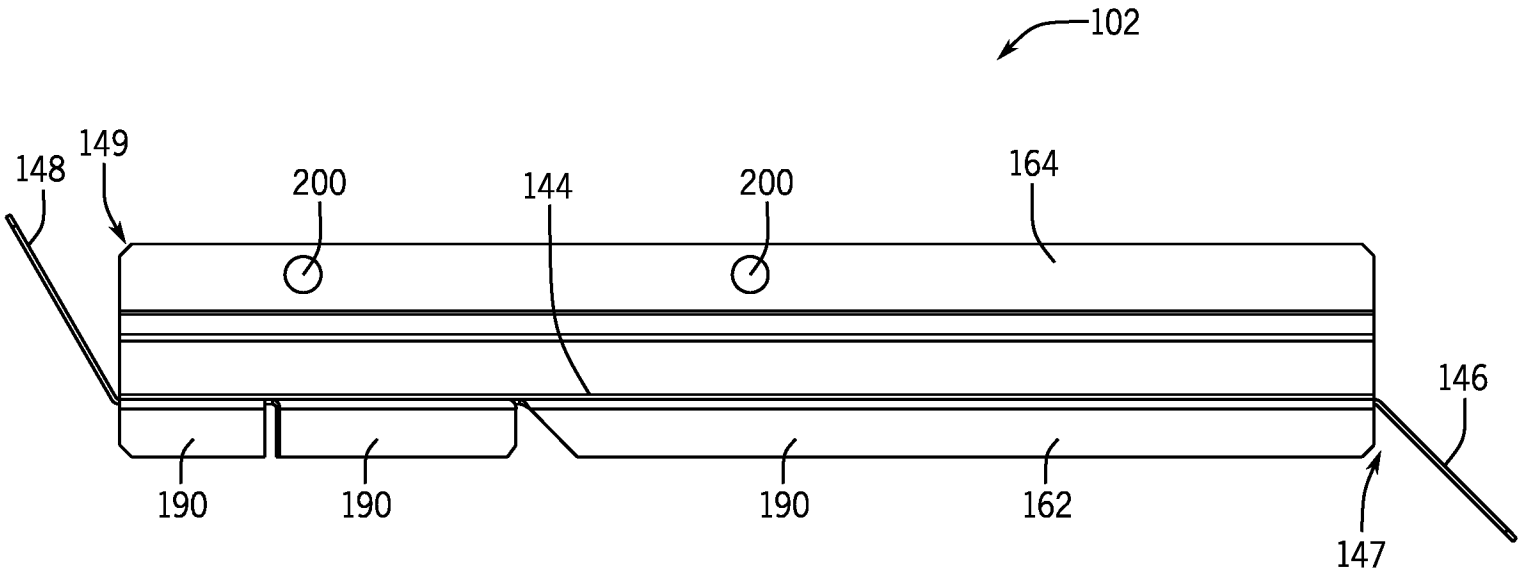
FIG. 9 is an elevation view of an embodiment of the cover, in accordance with an aspect of the present disclosure.
Figure 10:
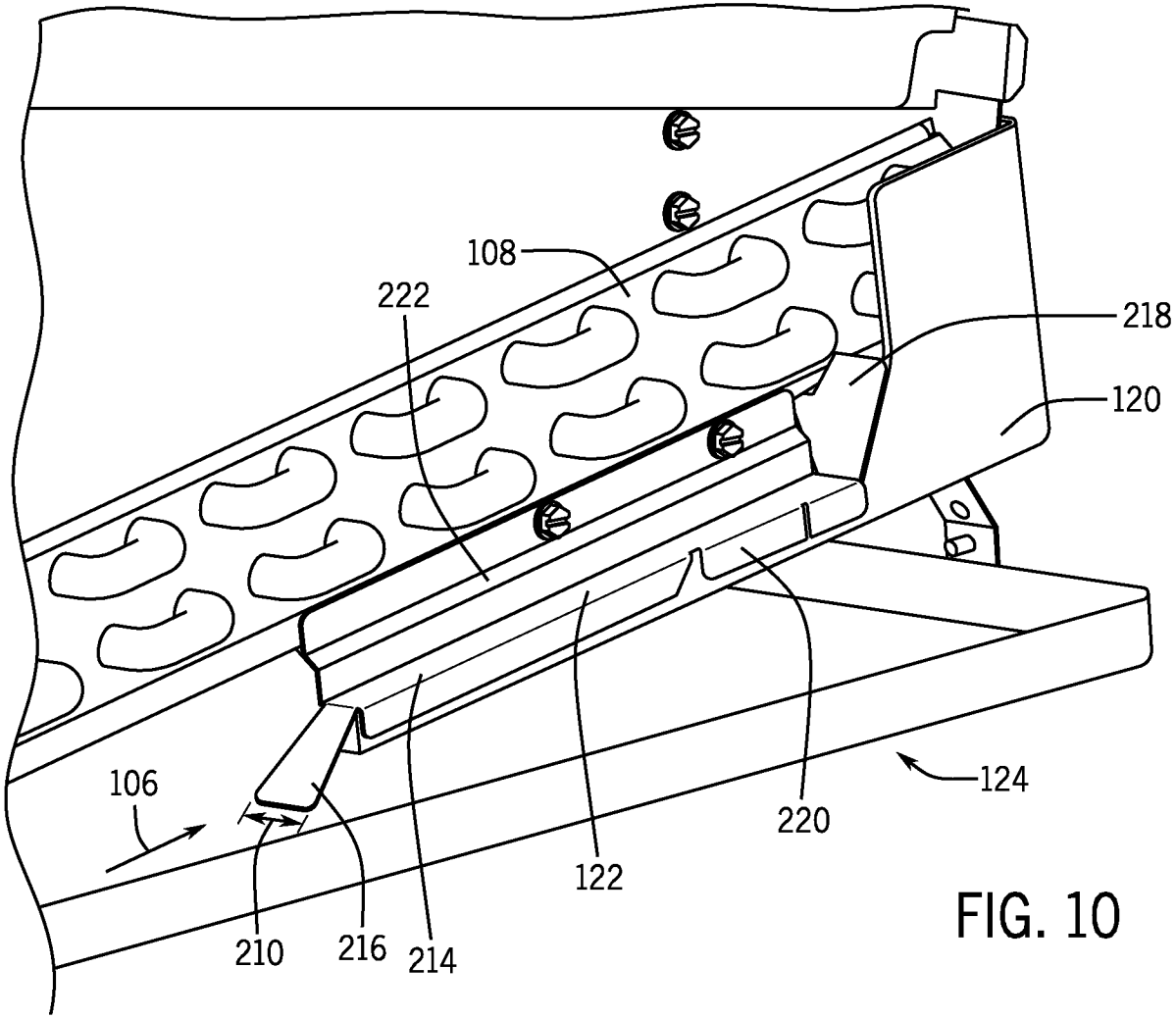
FIG. 10 is a partial perspective view of an embodiment of the cover disposed over the condensate collection trough of the heat exchanger, in accordance with an aspect of the present disclosure.
Figure 11:
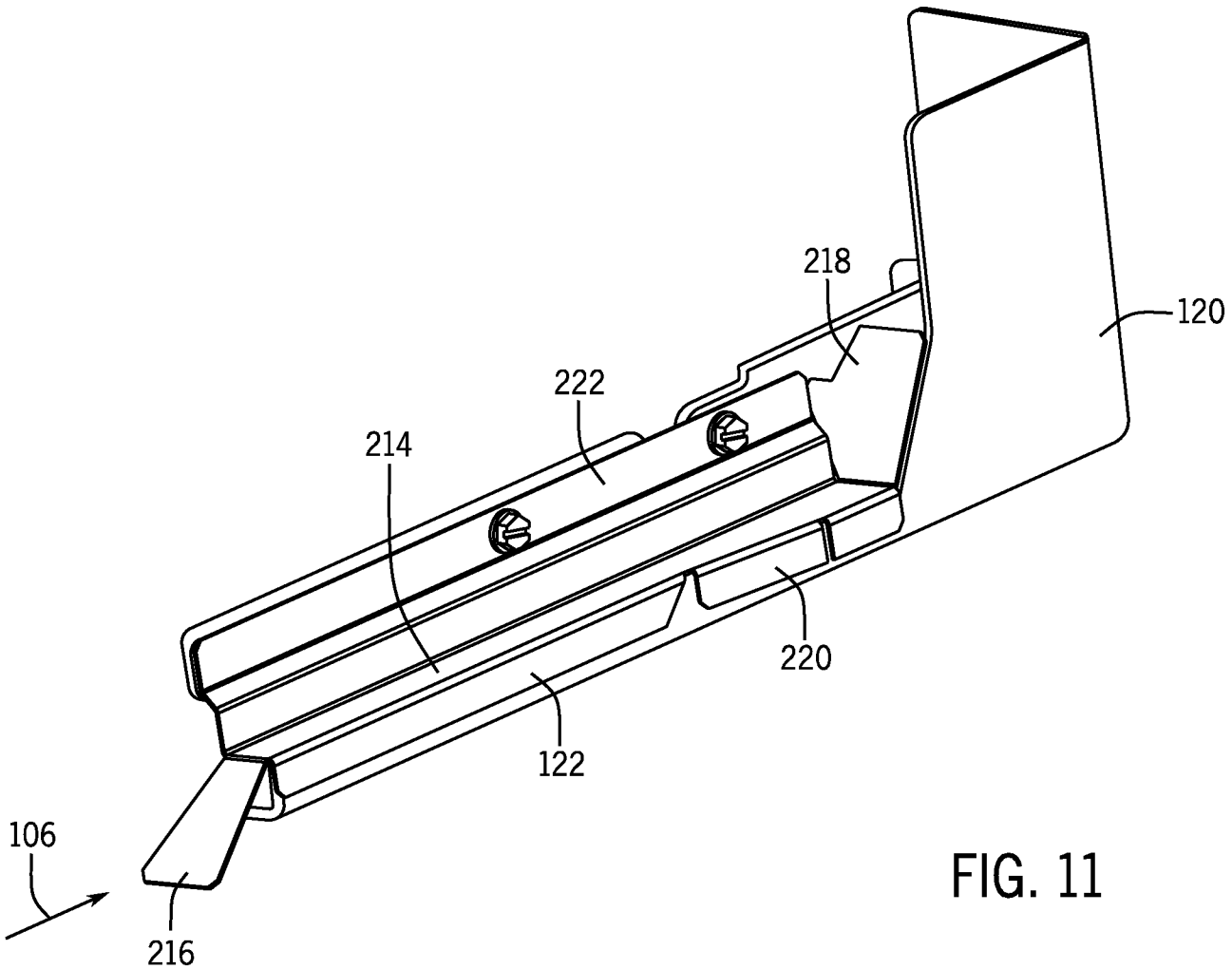
FIG. 11 is a perspective view of an embodiment of the cover coupled to the condensate collection trough, in accordance with an aspect of the present disclosure.
Figure 12:
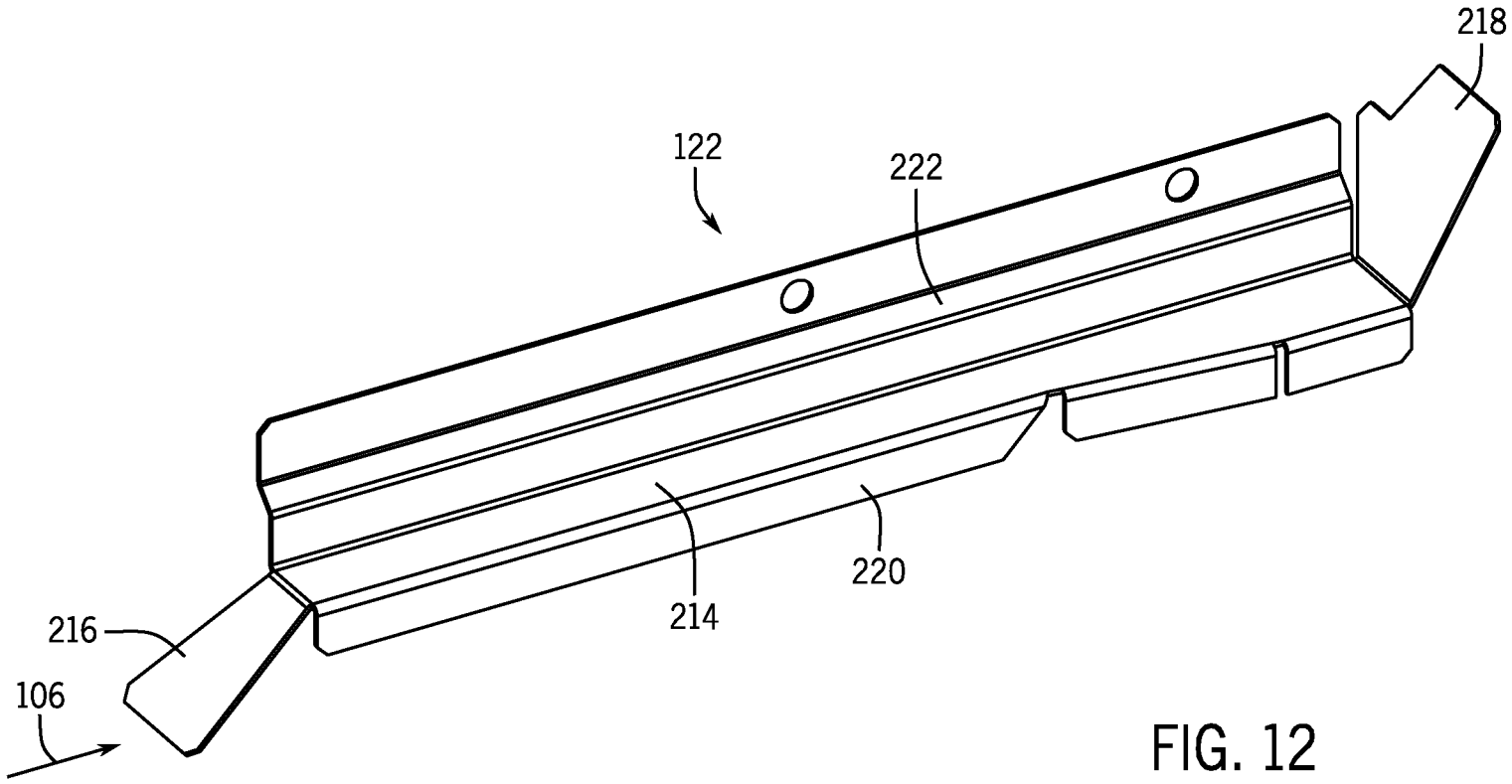
FIG. 12 is a perspective view of an embodiment of the cover, in accordance with an aspect of the present disclosure.
Figure 13:
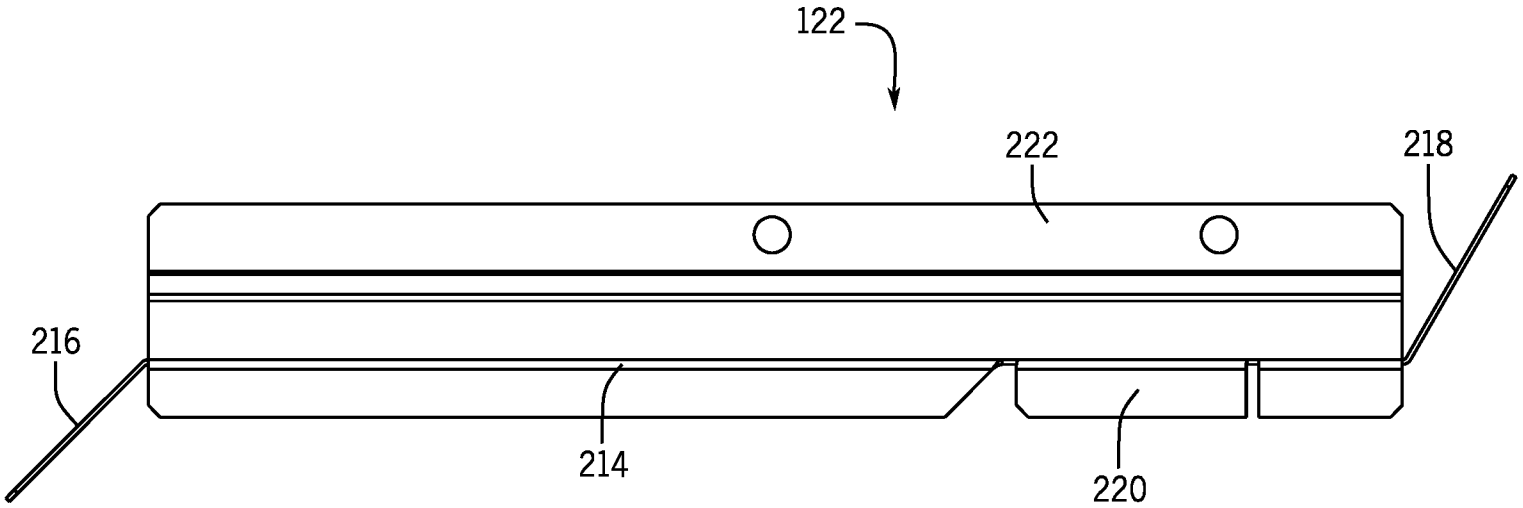
FIG. 13 is an elevation view of an embodiment of the cover, in accordance with an aspect of the present disclosure.

FIGS. 8 and 9 are a perspective view and an elevation view, respectively, of embodiments of the cover 102. As shown in FIGS. 8 and 9, a single piece of material may be bent and/or otherwise manipulated to form the body portion 144, the first guide portion 146, the second guide portion 148, the overlap portion 162, and the coupling portion 164 of the cover 102. In some embodiments, the overlap portion 162 includes three segments 190 extending substantially crosswise from the body portion 144 to enable the overlap portion 162 to conform to a shape or contour of the channel 142 of the condensate collection trough 104. In other embodiments, the overlap portion 162 may include another suitable number of segments 190 that enable the overlap portion 162 to block, restrict, and/or prevent the airflow 106 from flowing through an opening or space between the body portion 144 and the channel 142.

Further, in some embodiments, the coupling portion 164 includes prefabricated openings 200 configured to receive the fasteners 180 that couple the cover 102 and the condensate collection trough 104 to the coil 140 and/or another coil 108. In other embodiments, the coupling portion 164 may not include the prefabricated openings 200, such that openings may be formed through the coupling portion 164 upon insertion of the fasteners 180 through the cover 102, the condensate collection trough 104, and/or the coil 140.

While the cover 102 shown in the embodiments of FIGS. 8 and 9 includes a particular shape, it should be noted that the cover 102 may include any suitable shape that enables the cover 102 to conform to, and/or otherwise be disposed over, the channel 142 of the condensate collection trough 104 to block airflow 106 from entering the channel 142. For instance, FIGS. 10-13 illustrate embodiments of the second cover 122 configured to be disposed over the second condensate collection trough 120 on the side 124 of the heat exchanger 100. As shown in the illustrated embodiments of FIGS. 6 and 10, portions of tubes of the coils 108 positioned on the side 124 of the heat exchanger 100 may not extend laterally outward from the heat exchanger 100 as much as portions of the tubes of the coils 108 positioned on the side 126 of the heat exchanger 100. Accordingly, the second cover 122 and/or the second condensate collection trough 120 may include a thickness or width 210 that is less than a thickness or width 212 of the cover 102 and the condensate collection trough 104. While the thicknesses or widths of the second cover 122 and the cover 102 may differ, in some embodiments, the general shape of the second cover 122 and the cover 102 may be substantially the same. In other embodiments, the shapes of the covers 102, 122 may be different depending on a configuration of the coils 108 of the heat exchanger 100.

In any case, the second cover 122 may be configured to cover the second condensate collection trough 120 to block, restrict, or prevent the airflow 106 from contacting, blowing, or otherwise directing condensate in the second condensate collection trough 120 out of the second condensate collection trough 120 and/or toward the building 10. Similar to the cover 102, the second cover 122 includes a body portion 214, a first guide portion 216, a second guide portion 218, an overlap portion 220, and a coupling portion 222. In some cases, the body portion 214, the first guide portion 216, the second guide portion 218, the overlap portion 220, and/or the coupling portion 222 may include reduced sizes, such as lengths, heights, or widths, when compared to the body portion 144, the first guide portion 146, the second guide portion 148, the overlap portion 162, and/or the coupling 164 of the cover 102. In other embodiments, the body portion 214, the first guide portion 216, the second guide portion 218, the overlap portion 220, and/or the coupling portion 222 may include the same or an increased size, such as length, height, or width, when compared to the body portion 144, the first guide portion 146, the second guide portion 148, the overlap portion 162, and/or the coupling 164 of the cover 102. For example, the sizes of the covers 102, 122 may be scaled or selected based on a distance at which the tubes of the coils 108 laterally or otherwise extend from the sides 124, 126 of the heat exchanger 100. In any case, the second cover 122 may be sized to cover the second condensate collection trough 120 and block airflow 106 from entering the channel of the second condensate collection trough 120.

As set forth above, embodiments of the present disclosure may provide one or more technical effects useful for reducing contact between airflow and condensate to block, reduce, or prevent an amount of condensate from being directed into an environment to be conditioned by an HVAC system. For example, embodiments of the present disclosure are directed to a cover that is disposed over a condensate collection trough of a heat exchanger that is included in the HVAC system. The cover is configured to block, restrict, or prevent an airflow that flows across the heat exchanger from contacting condensate within the condensate collection trough. The cover may include a body portion that is disposed over a channel of the condensate collection trough, guide portions to shield openings of the condensate collection trough and direct the airflow over an external surface of the body portion, and/or a coupling portion that enables the cover to be coupled to the condensate collection trough and/or the heat exchanger. In some embodiments, the heat exchanger may be utilize the cover when positioned in a horizontal left configuration. In any case, the airflow across the heat exchanger may be blocked, restricted, or prevented from contacting the condensate in the channel of the condensate collection trough, which may reduce an amount of condensate that is mixed with the airflow and directed toward the environment to be conditioned by the HVAC system. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A condensate collection assembly for a heat exchanger, comprising:

a condensate collection trough configured to couple to the heat exchanger, the condensate collection trough having a condensate receptacle and a channel, wherein the condensate receptacle is configured to be downstream of the channel relative to a direction of air flow along an air flow path extending across the heat exchanger, the condensate receptacle is configured to be positioned adjacent to a condensate flow path of the heat exchanger and receive a condensate from the condensate flow path, and the channel is configured to direct the condensate from the condensate receptacle to a condensate pan; and a cover extending along a portion of the condensate collection trough to cover the channel and expose the condensate receptacle to the heat exchanger, wherein the cover comprises a guide portion extending from a body portion of the cover in an upstream direction with respect to the direction of the air flow across the heat exchanger, wherein the guide portion extends from the body portion at an oblique angle relative to the body portion to occlude an outlet of the channel to restrict the air flow from entering the channel, wherein the cover comprises an additional guide portion extending from the body portion in a downstream direction, opposite the upstream direction, and wherein the additional guide portion is configured to divert the air flow over the condensate receptacle to block the air flow from entering the condensate receptacle.

2. The condensate collection assembly of claim 1, wherein the cover is configured to couple to the heat exchanger.

3. The condensate collection assembly of claim 1, wherein the cover is configured to couple to the condensate collection trough.

4. The condensate collection assembly of claim 1, wherein the condensate collection trough has a length terminating at an edge of the condensate collection trough, wherein the channel extends along the length, wherein the body portion is disposed over the channel, and wherein the guide portion extends beyond the edge of the condensate collection trough.

5. The condensate collection assembly of claim 4, wherein the body portion comprises an upper surface, wherein the guide portion is configured to receive the air flow and direct the air flow toward and over the upper surface of the body portion.

6. The condensate collection assembly of claim 1, wherein the body portion comprises a first end, a second end opposite the first end, a first side, and a second side opposite the first side, wherein the guide portion extends from the first end and protrudes beyond an edge of the condensate collection trough in the upstream direction, and wherein the additional guide portion extends from the second end in the downstream direction toward the condensate receptacle.

7. The condensate collection assembly of claim 6, wherein the additional guide portion extends from the body portion at an additional oblique angle relative to the body portion.

8. The condensate collection assembly of claim 7, wherein the additional guide portion comprises a groove configured to receive a tube of the heat exchanger.

9. The condensate collection assembly of claim 6, wherein the cover further comprises a coupling flange extending from the first side of the body portion, wherein the coupling flange is configured to removably couple the cover to the heat exchanger, the condensate collection trough, or both.

10. The condensate collection assembly of claim 9, wherein the cover further comprises an overlap portion extending from the second side of the body portion, wherein the overlap portion extends from the body portion at an angle relative to the body portion and is configured to restrict the air flow from entering a gap between the body portion and the channel.

11. The condensate collection assembly of claim 1, wherein the cover comprises a single sheet of material.

12. The condensate collection assembly of claim 1, wherein the cover comprises a metallic material, and the condensate collection trough comprises a polymeric material.

13. The condensate collection assembly of claim 1, wherein the cover is configured to restrict the air flow from entering the channel when the heat exchanger is in a horizontal left position.

14. The condensate collection assembly of claim 1, wherein condensate receptacle comprises a first height that is greater than a second height of the channel.

15. A heating, ventilation, and/or air conditioning (HVAC) system, comprising:

a heat exchanger configured to place a working fluid in a heat exchange relationship with an air flow; and a condensate collection assembly, comprising:

a condensate collection trough having a condensate receptacle and a channel, wherein the condensate receptacle is downstream of the channel relative to a direction of the air flow along an air flow path across the heat exchanger, wherein the condensate collection trough is coupled to the heat exchanger, the condensate receptacle is positioned adjacent to a condensate flow path of the heat exchanger and configured to receive condensate from the condensate flow path, and the channel is configured to direct the condensate from the condensate receptacle to a condensate pan; and a cover extending along a portion of the condensate collection trough to cover the channel and expose the condensate receptacle to the heat exchanger, wherein the cover comprises a body portion, a coupling flange, and a guide portion, wherein the coupling flange extends from the body portion and is configured to removably couple the cover to a wall of the condensate collection trough, wherein the guide portion extends from the body portion in an upstream direction with respect to the direction of the air flow across the heat exchanger, wherein the guide portion extends from the body portion at an oblique angle relative to the body portion to occlude an outlet of the channel to restrict the air flow from entering the channel, wherein the cover comprises an additional guide portion extending from the body portion in a downstream direction, opposite the upstream direction, and wherein the additional guide portion is configured to divert the air flow over the condensate receptacle to block the air flow from entering the condensate receptacle.

16. The HVAC system of claim 15, wherein the condensate collection trough extends along and is positioned above the condensate pan, with respect to a direction of gravity, and has a length terminating at an edge of the condensate collection trough, wherein the channel extends along the length, wherein the body portion is disposed over the channel, and wherein the guide portion extends from the body portion and protrudes beyond the edge of the condensate collection trough.

17. The HVAC system of claim 16, wherein the edge of the condensate collection trough is spaced apart from the condensate pan by a first gap in an installed configuration of the condensate collection assembly with the heat exchanger, and wherein a vertex of the guide portion is spaced apart from the condensate pan by a second gap in the installed configuration.

18. The HVAC system of claim 15, wherein the cover comprises a single sheet of material.

19. The HVAC system of claim 15, wherein the cover is configured to restrict the air flow from entering the channel when the heat exchanger is in a horizontal left position.

20. A cover for a condensate collection system, comprising:

a body portion having a first end, a second end opposite the first end, a first side, and a second side opposite the first side, wherein the body portion is configured to be disposed over a channel of a condensate collection trough of the condensate collection system, and wherein the condensate collection trough is configured to receive condensate generated by a heat exchanger;

a guide portion extending from the first end of the body portion, wherein the guide portion is configured to receive an air flow and direct the air flow from the first end to the second end over an external surface of the body portion and away from an outlet of the channel of the condensate collection trough, wherein the guide portion extends from the body portion at an oblique angle relative to the body portion;

an additional guide portion extending from the second end of the body portion at an additional oblique angle relative to the body portion, wherein, in an installed configuration of the cover with the condensate collection trough, the additional guide portion is configured to divert the air flow over a condensate receptacle of the condensate collection trough to block the air flow from entering the condensate receptacle; and a coupling flange extending from the first side of the body portion, wherein the coupling flange is configured to removably couple the cover to a wall forming the channel of the condensate collection trough.

21. The cover of claim 20, wherein the guide portion is configured to extend across the outlet of the channel to occlude the outlet and restrict the air flow from entering the channel.

22. The cover of claim 20, wherein the second guide portion comprises a groove configured to receive a tube of the heat exchanger.

23. The cover of claim 20, comprising an overlap portion configured to restrict the air flow from entering a gap between the body portion and the channel of the condensate collection trough, wherein the overlap portion extends from the second side of the body portion.

* * * * *